US006895849B2

(12) United States Patent
Rosene et al.

(10) Patent No.: US 6,895,849 B2
(45) Date of Patent: May 24, 2005

(54) STRIPPER PLATE RETENTION SYSTEM

(75) Inventors: Ronald G. Rosene, Coon Rapids, MN (US); Richard L. Timp, Vadnais Heights, MN (US); Verlon Robinson, Coon Rapids, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 139 days.

(21) Appl. No.: 10/165,052

(22) Filed: Jun. 7, 2002

(65) Prior Publication Data

US 2003/0226437 A1 Dec. 11, 2003

(51) Int. Cl.[7] ..... B21D 45/08; B26D 7/18

(52) U.S. Cl. ..... 83/698.41; 83/140; 83/684

(58) Field of Search ..... 83/684, 136, 129, 83/140, 588, 698.61, 699.41, 686, 698.91

(56) References Cited

U.S. PATENT DOCUMENTS

| | | | | |
|---|---|---|---|---|
| 3,079,824 | A | 3/1963 | Schott | 83/140 |
| 3,335,627 | A | 8/1967 | Smelts | 83/140 |
| 3,540,339 | A | 11/1970 | Killaly | 83/140 |
| 3,935,771 | A | 2/1976 | Cady, Jr. | 83/140 |
| 4,041,817 | A | 8/1977 | Nelson | 83/139 |
| 4,092,888 | A | 6/1978 | Wilson | |
| 4,113,227 | A | 9/1978 | Cigliano | 403/316 |
| 4,121,893 | A | 10/1978 | Morissette | 403/143 |
| 4,248,111 | A | 2/1981 | Wilson et al. | 83/140 |
| 4,261,237 | A | 4/1981 | DiDonato, Jr. et al. | 83/139 |
| 4,446,767 | A | 5/1984 | Wilson | 83/136 |
| 4,947,718 | A | 8/1990 | Whistler | |
| 4,989,484 | A | 2/1991 | Johnson et al. | 83/140 |
| 5,054,347 | A | 10/1991 | Johnson | |
| 5,056,391 | A | 10/1991 | Stewart | 83/139 |
| 5,056,392 | A | 10/1991 | Johnson | |
| 5,081,891 | A | 1/1992 | Johnson | |
| 5,127,293 | A | 7/1992 | Chatham | 83/136 |
| 5,271,303 | A | 12/1993 | Chatham | 83/136 |
| 5,301,580 | A | 4/1994 | Rosene | |
| 6,047,621 | A | 4/2000 | Dries et al. | 83/136 |
| 6,082,516 | A | 7/2000 | Willer | |
| 6,311,597 | B1 | 11/2001 | Schroth et al. | 83/531 |

FOREIGN PATENT DOCUMENTS

| | | | |
|---|---|---|---|
| EP | 0770437 | 5/1997 | B21D/45/00 |
| GB | 1251843 | 2/1968 | |

*Primary Examiner*—Charles Goodman
(74) *Attorney, Agent, or Firm*—Fredrikson & Byron, PA

(57) ABSTRACT

A punch guide assembly is provided for removably carrying a stripper plate. The punch guide assembly comprises a punch guide and a stripper plate guide movable axially with respect to the punch guide. The stripper plate guide has a locked position wherein the stripper plate is secured to the punch guide assembly and an unlocked position wherein the stripper plate can be readily removed from the punch guide assembly. The stripper plate guide is resiliently biased axially toward its unlocked position yet is restrained against axial movement relative to the punch guide when in its locked position.

40 Claims, 9 Drawing Sheets

STRIPPER PLATE RETENTION SYSTEM

FIELD OF THE INVENTION

The present invention relates generally to punch guides, such as those used with industrial punch presses. More particularly, this invention relates to stripper plate retention assemblies for punch guides and the like.

BACKGROUND OF THE INVENTION

Multiple-station turret punch machines can provide up to 72 different punch stations for use in conjunction with a like number of opposing dies. In such a machine, each punch station operates as a punch set holder for a removable punch set that includes a centrally-disposed punch surrounded by a punch guide and biased by a punch spring. Even with the flexibility afforded by a 72-station machine, the operator may wish to change some or all of the punch set and die combinations from time to time. For instance, the operator may wish to utilize a different punch tip shape or size in a punch set. It is desirable to minimize the time required, and make it simple, to change the punch and die components, so that down time on the punch machine is minimized.

In a punching operation, after the punch tip strikes the workpiece, the punched workpiece surface will tend to catch, and hence follow, the punch tip as it retracts. The stripper plate has an opening in which the punch tip fits snugly yet can axially move freely through the opening. In use, the punch guide is oriented with the stripper plate flush against the workpiece surface. When the punch tip retracts from the workpiece at the end of a punching operation, the edges of the workpiece around the punch hole will be prevented by the stripper plate from following the retracting punch tip.

Certain punch guide configurations incorporate the stripper plate as an integral part of the punch guide itself. However, since the size and shape of the stripper plate hole must coincide closely with that of the punch tip, each punch guide of the nature is limited to use with a matching punch. Consequently, it may be inconvenient to interchange punch and die combinations, since the operator must change not only the die and punch, but the punch guide as well.

Another configuration uses a flattened metal clip or the like to retain a removable stripper plate at the end of a punch guide. This allows the use of a number of different punches with each guide, since only the stripper plate needs to be changed to accommodate a new punch. These spring clip structures, however, have not provided completely satisfactory performance. Often, the workpiece surface will have a thin coating of oil or other fluid. When the stripper plate meets the workpiece surface, a suction may be created. When this occurs, the stripper plate may be pulled out of place and damage may result to the workpiece and to the stripper plate. Down time may also be a problem. Finally, these clips tend to weaken with continued use, potentially aggravating the noted problems.

Another configuration is shown in commonly assigned U.S. Pat. No. 4,092,888, which depicts a punch guide assembly using a resilient, flat retaining ring to retain a removable stripper plate.

In still another configuration, commonly assigned U.S. Pat. No. 4,248,111 depicts a punch guide assembly that employs stripper plate holding tabs which are on clips attached parallel to the axis of the punch guide.

A further configuration is shown in commonly assigned U.S. Pat. No. 4,446,767, wherein a locking ring 13 is fitted in matching circumferential grooves in a stripper plate 22 in the punch guide sleeve 11. The free ends 31 of the locking ring 13 include tabs 32 that can be spread apart and locked into position by the locking ring expansion lock 14. Although installation and removal of the stripper plate is relatively simple, it involves handling the loose ring 13 and the cap screw used as the locking ring expansion lock 14. In some cases, the manipulation of these small parts may be more difficult and time consuming than is preferred.

Other mechanisms for retaining stripper plates on punch guides are described in U.K. patent specification 1 251 843 and U.S. Pat. No. 3,079,824, to Schoft, U.S. Pat. No. 3,540,339, to Killaly, U.S. Pat. No. 4,947,718, to Whistler, and U.S. Pat. No. 4,989,484, to Johnson et al.

In the U.K. patent specification, an O-ring 25 in annular mating grooves in the punch guide sleeve and the stripper plate provides a snap fit of the stripper plate 21 to the punch guide 18. The '824 patent also illustrates a snap ring 38 for retaining the stripper plate 36 in position. Such snap rings may neither be strong enough nor reliable enough to securely lock the stripper plate in position.

The '339 patent employs retainers 60 and spring-mounted elements 56 for engagement against V-shaped annular detent grooves 57 in the edge of the stripper plate 62. Attachment and removal involves loosening the retainers 60 and moving them aside to snap-in or unsnap the spring-loaded catches 56 in or out of the grooves. The redundant attachment mechanism requires additional steps in releasing or locking the stripper plate.

The '718 patent shows the use of spring clips 194 attached to the punch guide and engaging internally-threaded flanges 196 in the stripper plate 46 in a fashion similar to the '111 patent. Such spring clips may not be strong enough for large diameter punch sets and may weaken with repeated use.

The '484 patent discloses a complex locking ring 80 with positioning springs 90, 92 located within a groove and positioned between a pair of diametrically-opposed pins 94, 96 that engage other pins, such as 98, to hold the ring 80 in the lock position. The stripper plate 74 is held in place in the locking ring by centrally-extending flanges 109 and pin-receiving slots 110. To remove or replace the stripper plate 74, the locking ring 80 is turned about the axis of the punch assembly against the compression of the springs 90, 92, thereby aligning the pin-receiving slots 110 with the pin 74D and allowing the stripper plate 74 to be removed and re-inserted in the fashion of a bayonet-lock mechanism. Then, by pushing the stripper plate in and depressing the release pin 112, the springs 90, 92 rotate the locking ring 80 on the box 76 so the flanges 109 cover the pins 74D, thereby holding the stripper plate 74 securely in place on the end of the punch assembly 10. This rotatable retaining ring and stripper plate assembly includes a number of small parts, such as pins and springs, that add complexity and fabrication costs. Moreover, the stripper plate retaining ring itself is removed when the stripper plate is released, thus potentially risking its loss or damage if dropped.

U.S. Pat. No. 6,047,621 discloses another mechanism for removing and replacing a stripper plate from a punch guide. This mechanism includes slides 80 mounted on a punch guide for axial movement along the front end of the guide. The slides 80 are forwardly and rearwardly movable between locked and unlocked positions. Each slide 80 is locked in position by a spring-loaded button assembly 82 extending radially from the guide 14 through an opening 84 in the lower portion of the slide 80. To release the stripper plate 20, the button 82 is pressed inward, thereby releasing the slide 80. The slide is then urged forward, which causes a ball bearing 86 positioned between an upper, recessed inner surface 88 of the slide 80 and a groove 90 in the periphery of the stripper plate 20 to move radially outward. This causes the ball bearing 86 to move out of engagement with the groove 90 in the outer edge of the stripper plate. Thus, to release the stripper plate 20, one must depress the button on each of the slides 80 and then push each of the slides 80 to the front of the guide. This is less than ideal in terms of ease of stripper plate removal and replacement.

U.S. Pat. No. 6,082,516 discloses a stripper plate release mechanism comprising a locking ring with three arcuate grooves having radially-increasing dimension and three locking clips which are circumferentially fixed relative to the locking ring. The locking clips engage the stripper plate. Upon rotation of the locking ring, the locking clips ride in the arcuate grooves which act as camming surfaces and open the locking clips, thereby releasing the stripper plate. As with certain other prior art stripper plate release mechanisms, this mechanism requires a rotation step to release the stripper plate. It would be desirable to provide a stripper plate release mechanism that does not require rotation or substantial manipulation to remove and replace the stripper plate.

Thus, it can be appreciated that, despite the effort put into designing various types of attachment mechanisms for stripper plates, a need still exists for simple, strong, reliable, and inexpensive-to-manufacture stripper plate locking mechanisms that are easy and quick to use in releasing or attaching the stripper plate, and which securely hold the stripper plate when locked.

SUMMARY OF THE INVENTION

Certain embodiments of the present invention provide a punch guide assembly for removably carrying a stripper plate. The punch guide assembly comprises a punch guide and a stripper plate guide movable axially with respect to the punch guide. The stripper plate guide has a locked position wherein the stripper plate is secured to the punch guide assembly and an unlocked position wherein the stripper plate can be readily removed from the punch guide assembly. The stripper plate guide is resiliently biased axially toward its unlocked position yet is restrained against axial movement relative to the punch guide when in its locked position.

DETAILED DESCRIPTION OF PREFERRED EMBODIMENTS

Figure 1:
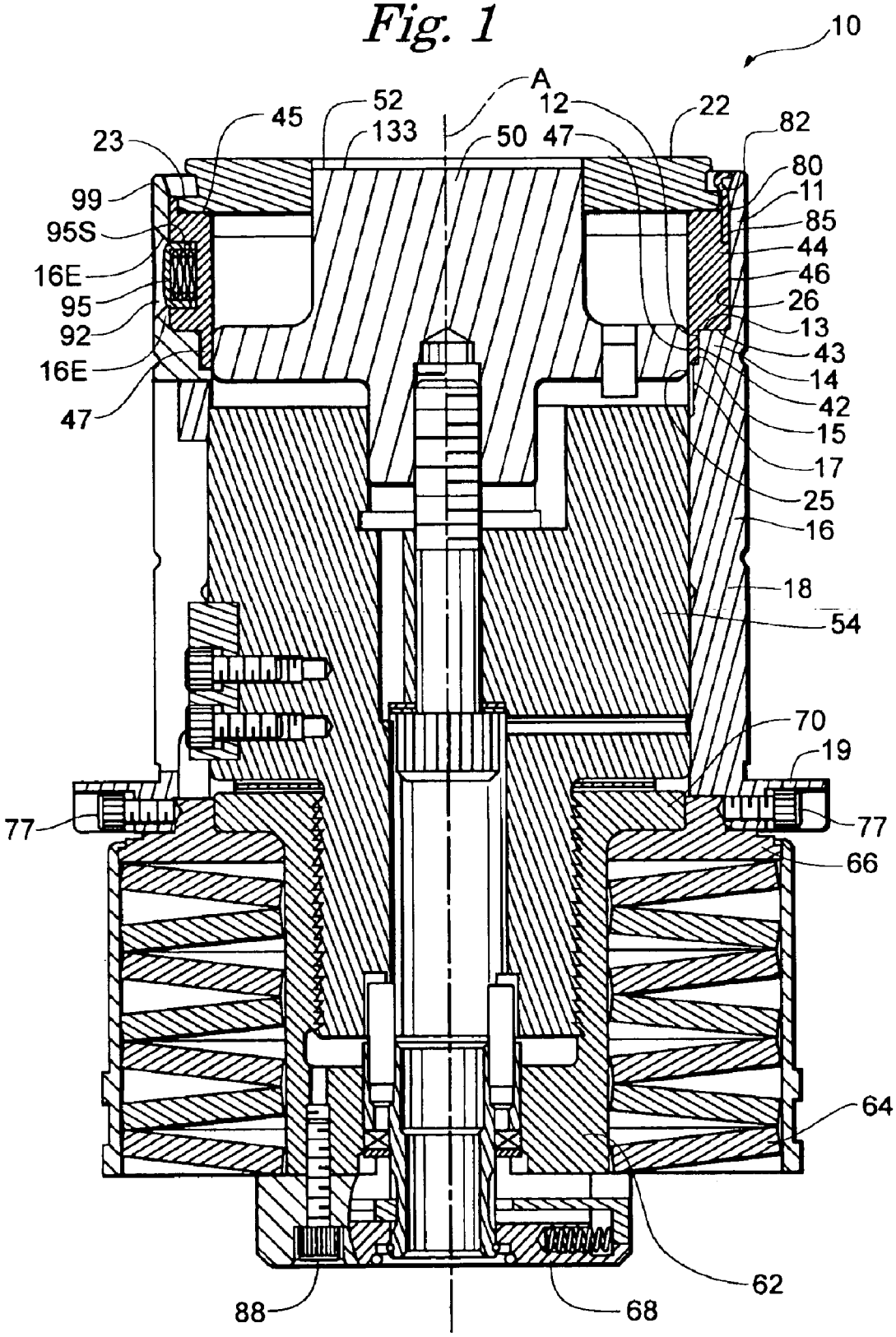
FIG. 1 is a cross-sectional view of a punch guide assembly in accordance with certain embodiments of the present invention.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the examples provided herein have many useful alternatives that fall within the scope of the invention.

FIG. 1 illustrates a punch assembly 10 comprising a stripper plate retention system in accordance with one embodiment of the present invention. The illustrated punch assembly 10 generally includes a punch 50, a punch guide 16, a stripper plate 22, a stripper plate guide 44, a punch holder 54, and a punch driver 62. The punch 50 is centrally disposed and has a punch tip 52 adapted to extend through an opening 13 in the stripper plate 22. The illustrated punch assembly 10 includes a punch spring 64 surrounding the punch driver 62. The punch spring 64 is held in position by collar 66 and block 68. Collar 66 is secured to the punch guide 16 by fasteners 77, and block 68 is secured to the punch driver 62 by fasteners 88. The collar 66, when assembled, also bears against the flange 70 of the punch driver 62 to maintain the noted components in the assembled state depicted in FIG. 1.

It will be appreciated, of course, that the present stripper plate retention system is not limited to use with the punch assembly 10 shown in FIG. 1. Rather, the stripper plate retention system can be used with a wide variety of different types of punch assemblies, as will be apparent to skilled artisans.

As is well known in the present art, in use, the punch guide 16 is inserted into, for example, a holder in the turret of a punch press (not shown), and the ram of the punch press strikes the punch driver 62 to force the punch tip 52 through a workpiece (not shown) into the opening of a matching die (not shown). The punch spring 64 is thus compressed during the punching operation and operates to withdraw the punch tip 52 from the die and workpiece upon retraction of the ram. In this process, the stripper plate 22 operates in a well known manner to strip away the punched-out blank and other debris that becomes attached to the punch tip 52.

With continued reference to FIG. 1, it can be appreciated that the punch guide 16 is part of a punch guide assembly for removably carrying the stripper plate 22. The punch guide assembly also comprises a stripper plate guide 44 that is movable axially (i.e., along the axis A of the punch guide 16) with respect to the punch guide 16. The stripper plate guide 44 has a locked position (depicted in FIGS. 1, 3A–3B, 4A, and 5A), wherein the stripper plate 22 is secured to the punch guide assembly, and an unlocked position (depicted in FIGS. 2, 3C–3D, 4B, and 5B), wherein the stripper plate 22 can be readily removed from the punch guide assembly. Thus, the punch guide assembly is adapted to removably retain the stripper plate 22.

The stripper plate guide 44 is resiliently biased axially toward its unlocked position. Thus, the stripper plate guide 44 is moved to its unlocked position when the stripper plate guide 44 is not restrained (as described below) against axial movement relative to the punch guide 16. In certain embodiments, the stripper plate guide 44 is resiliently biased by at least one spring 111 bearing against the stripper plate guide 44. For example, the assembly may comprise a plurality of springs 111 extending between the stripper plate guide 44 and the punch guide 16. A variety of mechanisms can be used to bias the stripper plate guide toward its unlocked position.

In certain embodiments, the stripper plate guide 44 is carried against an interior wall of the punch guide 16. This can be understood with reference to FIGS. 1 and 2, wherein the stripper plate guide 44 is mounted against the interior of the leading wall section 11 of the punch guide 16. As can be appreciated, this wall section 11 is at the leading (i.e., nearest the workpiece during use) end region of the punch guide 16. In the illustrated embodiment, the leading wall section 11 has an interiorly-facing (i.e., facing radially inward) surface 26 against which an exteriorly-facing (i.e., facing radially outward) surface 46 of the stripper plate guide 44 slides when the stripper plate guide 44 is moved axially with respect to the punch guide 16.

The illustrated punch guide 16 has a base wall section 18 extending between the leading wall section 11 and the base flange 19 of the punch guide 16. The leading wall section 11 preferably has a greater interior dimension (e.g., diameter) than the base wall section 18. Preferably, these wall sections 11, 18 have the same exterior dimensions (e.g., the same exterior diameter), such that the base wall section 18 has a greater wall thickness than the leading wall section 11. Accordingly, the base wall section 18 preferably has a first shoulder 14 defined by a first forward-facing (i.e., facing the workpiece during use) surface 13 and a first interiorly-facing surface 12. In preferred embodiments, the stripper plate guide 44 has a rear surface 43 which, when the stripper plate guide 44 is in its locked position, bears against the forward-facing surface 13 of the punch guide's first shoulder 14.

In particularly preferred embodiments, the base wall section 18 has a second shoulder 17 defined by a second forward-facing surface 15 and a second interiorly-facing surface 25. This optional second shoulder 17 is advantageous in that it can be configured to cooperate with a flange 47 on the stripper plate guide 44 to substantially conceal the springs 111 against exposure to dirt and other particles that can be detrimental to proper functioning of the springs 111. Particularly preferred embodiments of this nature are described below in further detail.

The stripper plate guide 44 preferably comprises a generally ring-shaped wall. This is best appreciated with reference to FIG. 9, wherein there is illustrated an exploded perspective view a punch guide 16, a stripper plate guide 44, and a stripper plate 22 in accordance with certain embodiments of the invention. In the present embodiments, the punch guide 16 comprises a generally-cylindrical wall against the interior of which (i.e., against the interior of the leading wall section 11 of which) the stripper plate guide 44 is carried. The stripper plate guide 44 in these embodiments preferably has an exterior diameter that is slightly less than the interior diameter of the punch guide wall against which the stripper plate guide 44 is carried. In particular, the exterior diameter of the exteriorly-facing surface 46 of the stripper plate guide 44 is preferably slightly less than the interior diameter of the interiorly-facing surface 26 of the punch guide 16. Thus, in the present embodiments, it can be appreciated that the ring-shaped stripper plate guide 44, when assembled operatively with the punch guide 16, is nested inside the cylindrical leading wall section 11 of the punch guide 16.

Figure 4A:
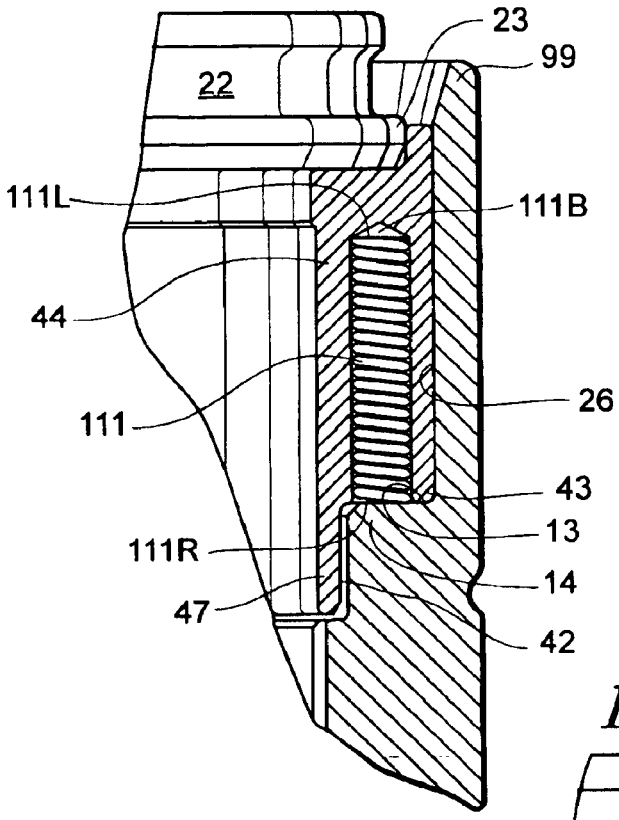
FIG. 4A is a cross-sectional view of a resiliently-biased stripper plate guide in a locked position in accordance with certain embodiments of the invention.
Figure 4B:
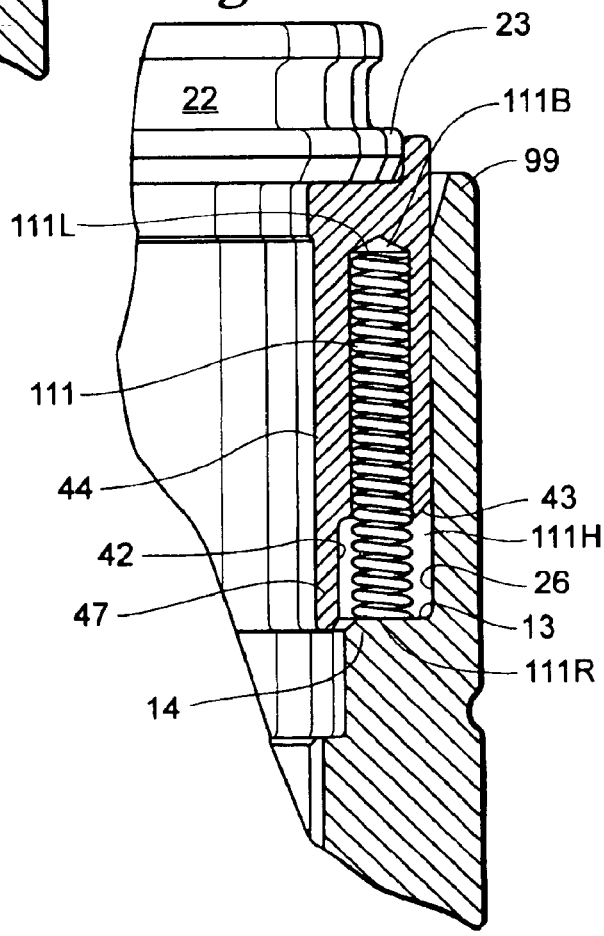
FIG. 4B is a cross-sectional view of the stripper plate guide of FIG. 4A depicted in an unlocked position.

As noted above, certain preferred embodiments provide a stripper plate guide 44 that is resiliently biased axially toward its unlocked position by at least one spring 111. This is perhaps best appreciated with reference to FIGS. 4A–4B, which illustrate a spring 111 mounted in a bore 111B formed in the stripper plate guide 44. Preferably, the length of the bore 111B is greater than the spring's solid length (i.e., the length of the spring 111 under sufficient load to bring all coils into contact with adjacent coils). As seen in FIG. 4B, the spring 111, when at its free length (i.e., the overall length of the spring 111 in its unloaded position), is preferably sized to extend somewhat out of the bore 111B. FIG. 4A depicts the spring 111 in a compressed state, which occurs when the stripper plate guide 44 is in its locked position. When so compressed, the leading end 111L of the spring 111 applies a forward force to the stripper plate guide 44, and the rear end 111R of the spring 111 applies a rearward force to the forward-facing surface 13 of the punch guide's first shoulder 14. Thus, the stripper plate guide 44 is urged by the spring 111 toward its unlocked position.

Figure 10:
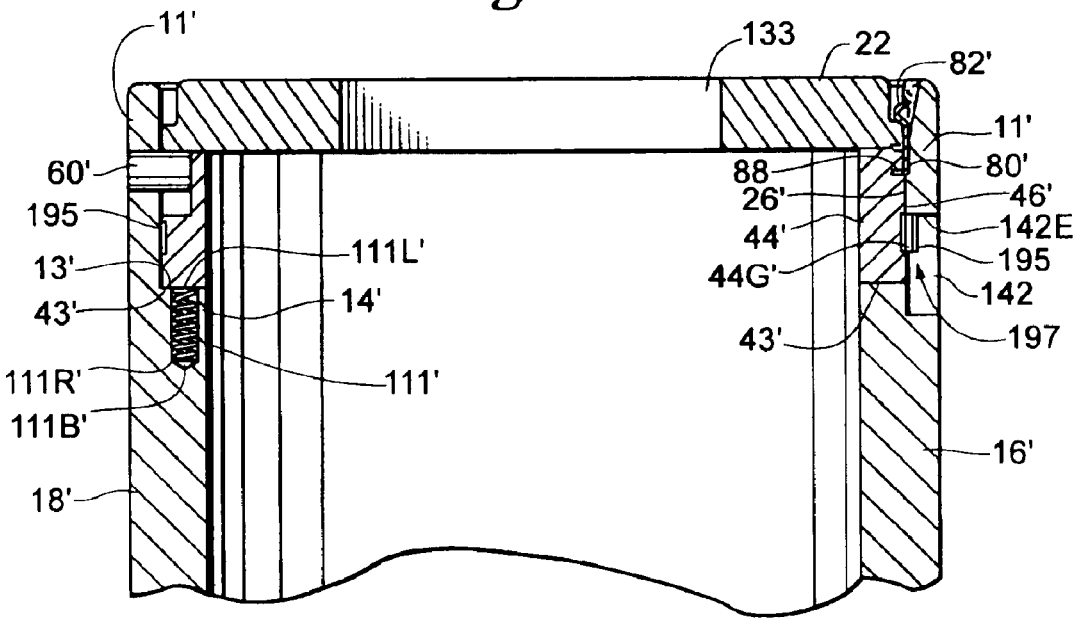
FIG. 10 is a cross-sectional view of a punch guide assembly in accordance with certain alternate embodiments of the invention.

In certain embodiments, the assembly includes at least one spring mounted in a bore formed in the punch guide 16. One embodiment of this nature is shown in FIG. 10, wherein the illustrated spring 111' is mounted in a bore 111B' formed in the base wall section 18' of the punch guide 16'. The illustrated spring 111' opens through a forward-facing surface 13' of the punch guide's shoulder 14'. The spring 111' is preferably sized to extend somewhat out of the bore 111B' when the spring 111' is at its free length. Thus, when the spring 111' is compressed, its leading end 111L' applies forward force to the rear surface 43' of the stripper plate guide 44', and its rear end 111R' applies rearward force to the base wall section 18' of the punch guide 16'.

Further, certain alternate embodiments (not shown) provide an assembly comprising at least one spring having its leading end (and its leading length) housed in a bore formed in the stripper plate guide 44 and having its rear end (and its rear length) housed in a bore formed in the punch guide 16.

The spring in such embodiments preferably has a free length that is somewhat greater than the combined length of both bores. Thus, when the spring is compressed, its leading end applies forward force to the stripper plate guide 44, and its rear end applies rearward force to the punch guide 16. Skilled artisans will recognize that a variety of other mechanisms can be used to bias the stripper plate guide and such mechanisms fall within the scope of the invention.

Figure 2:
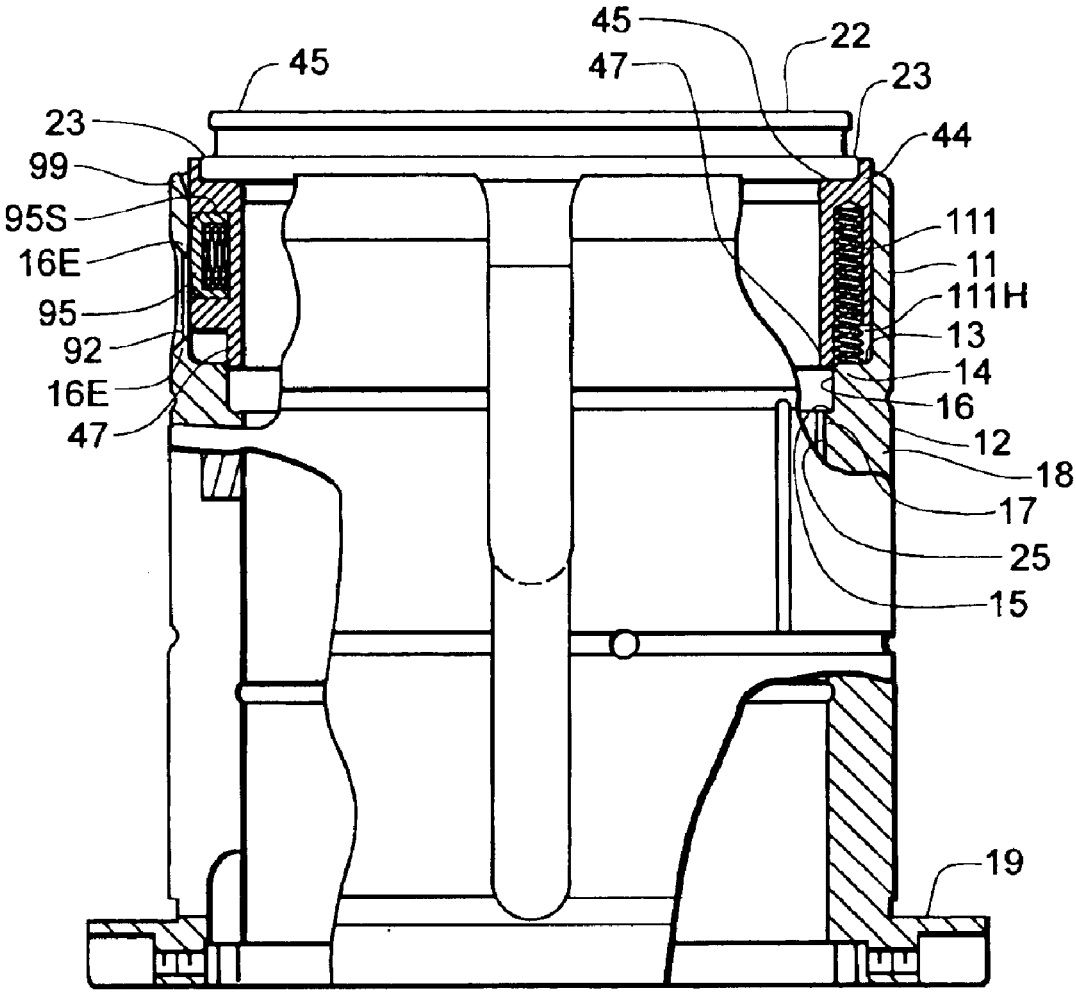
FIG. 2 is a partial cross-sectional view of the punch guide assembly of FIG. 1.

In certain particularly preferred embodiments, the stripper plate guide 44 is resiliently biased toward its unlocked position by a plurality of springs 111. For example, FIGS. 1 and 2 depict an embodiment wherein a plurality of springs 111 extend between the punch guide 16 and the stripper plate guide 44. In certain particularly preferred embodiments, the springs 111 are mounted in bores that are spaced about the circumference of the stripper plate guide 44. This can be appreciated by referring to FIG. 9. Essentially any number of springs 111 can be provided in the present embodiments. In one embodiment, five springs 111 are spaced every 72 degrees or so around the circumference of the stripper plate guide 44. In another embodiment, six springs are spaced every 60 degrees or so around the circumference of the stripper plate guide 44. Many other embodiments of this nature will be obvious to skilled artisans.

The invention provides a number of particularly preferred embodiments wherein the springs 111 are disposed within a substantially-concealed enclosure 111H whether the stripper plate guide 44 is in its locked position or its unlocked position. In fact, the springs 111 in these embodiments are maintained in this enclosure 111H at all positions between the locked position and the unlocked position. The spring enclosure 111H is preferably defined by the punch guide 16 in cooperation with the stripper plate guide 44. For example, in the embodiment of FIGS. 1 and 2, the stripper plate guide 44 has a flange 47 that overlaps a confronting interior surface 12 of the punch guide 16 by an extent that varies as the stripper plate guide 44 is moved between its locked position and its unlocked position. The extent of this overlap is greatest when the stripper plate guide 44 is in its locked position and least when the stripper plate guide 44 is in its unlocked position. It can be appreciated that the spring enclosure 111H is bounded collectively by the exteriorly-facing surface 42 of the stripper plate guide's flange 47, the rear surface 43 of the stripper plate guide 44, the forward-facing surface 13 of the punch guide's first shoulder 14, and a rear extent of the interior surface of the punch guide's leading wall section 11. The present embodiments are particularly advantageous because the springs 111 are maintained in the substantially-concealed enclosure 111H at all times during use. Thus, the springs 111 are protected against becoming contaminated with dirt and other particles that can be detrimental to proper functioning of the springs 111.

As noted above, the stripper plate guide 44 preferably is resiliently biased axially toward its unlocked position. When the stripper plate guide 44 is in its locked position, however, it preferably is restrained against axial movement relative to the punch guide 16. A variety of lock mechanisms can be used to restrain the stripper plate guide 44 when it is in its locked position. For example, a catch extending between the stripper plate guide 44 and the punch guide 16 can be used. The term "catch" is used herein to refer to any structure extending from the stripper plate guide 44 that can be selectively engaged with the punch guide 16, or any structure extending from the punch guide 16 that can be selectively engaged with the stripper plate guide 44, to restrain axial movement of the stripper plate guide 44 relative to the punch guide 16.

Figure 3A:
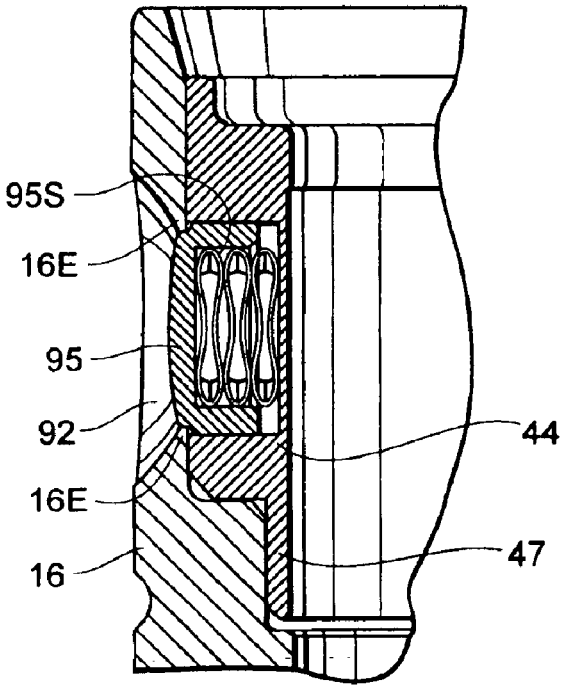
FIG. 3A is a cross-sectional view of a spring-loaded button assembly in a locked position on a stripper plate guide in accordance with certain embodiments of the invention.
Figure 3B:
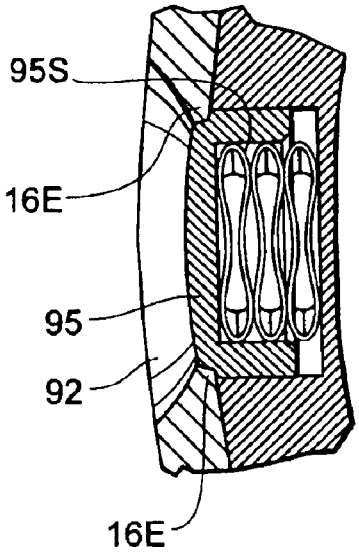
FIG. 3B is a detailed cross-sectional view of the locked button assembly of FIG. 3A.
Figure 3C:
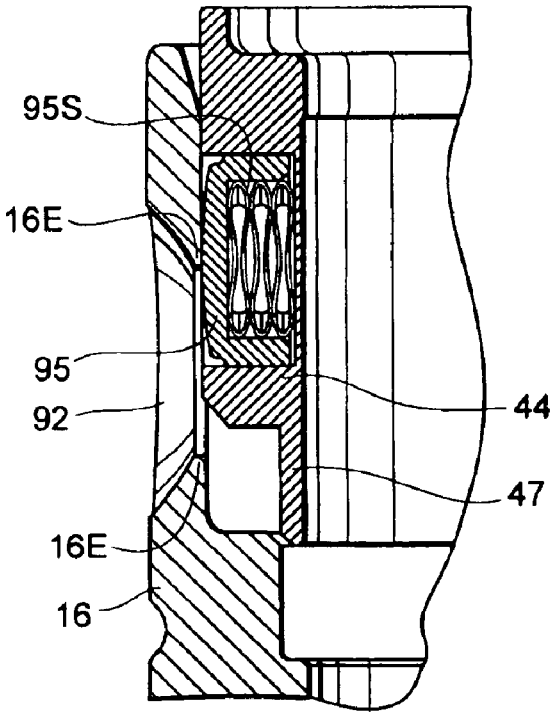
FIG. 3C is a cross-sectional view of the button assembly of FIG. 3A depicted in an unlocked position.
Figure 3D:
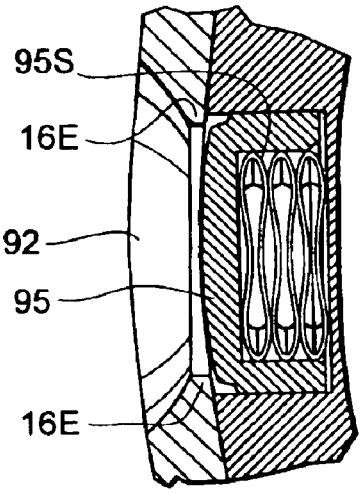
FIG. 3D is a detailed cross-sectional view of the unlocked button assembly of FIG. 3C.

In certain particularly preferred embodiments, the lock mechanism comprises a button assembly. This is perhaps best appreciated with reference to FIGS. 3A–3D in view of FIGS. 1 and 2, wherein the stripper plate guide 44 carries a spring-loaded button 95. While the illustrated button 95 is a one-piece locking button, a variety of locking buttons (e.g., two-piece locking buttons) can be used. As depicted in FIGS. 1 and 3A–3B, when the spring-loaded button 95 is in a locked position (i.e., when the spring 95S behind the button 95 is in an unloaded position), the outer portion of the button 95 extends into an opening 92 in the wall of the punch guide 44. This engagement of the button 95 and the wall surrounding and defining the opening 92 restrains the stripper plate guide 44 against axial movement relative to the punch guide 16. As depicted in FIGS. 3C–3D, when the button 95 is depressed (and moved out of engagement with the wall edges 16E that define the opening 92), the stripper plate guide 44 is free to move toward its unlocked position (i.e., axially forward with respect to the punch guide 16). With the button 95 so depressed, the springs 111 urge the stripper plate guide 44 toward (i.e., the stripper plate guide 44 is moved axially by the springs 111 into) its unlocked position.

Figure 11:
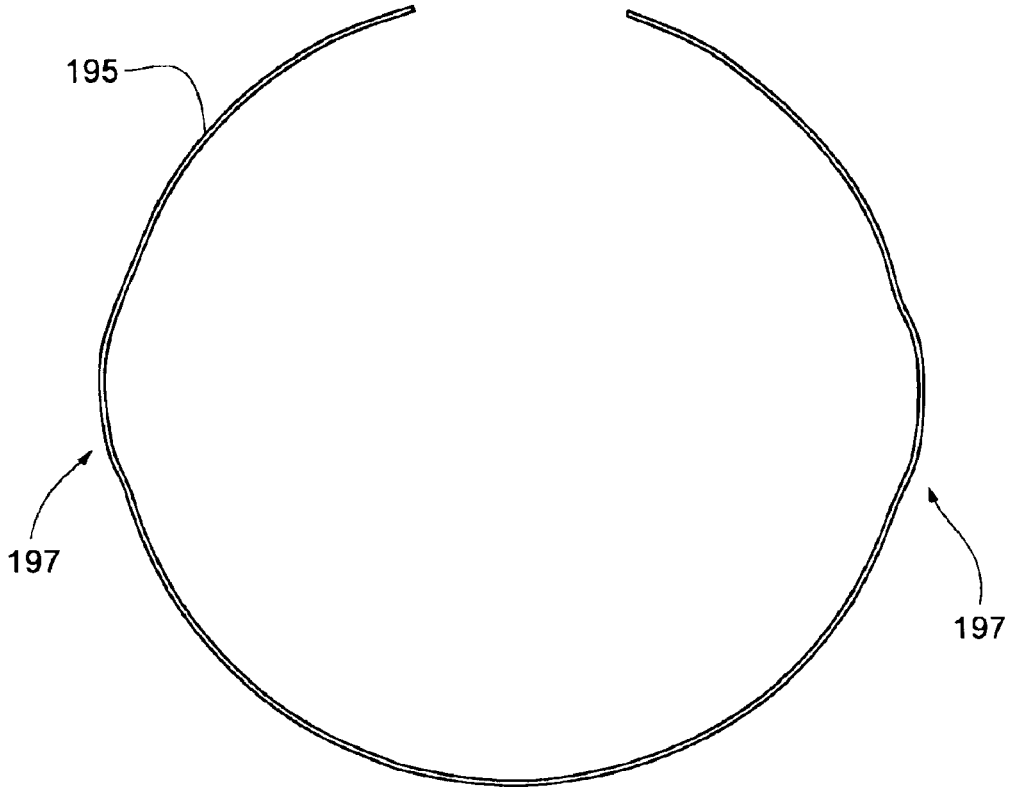
FIG. 11 is a side view of a spring ring used in certain alternate embodiments of the invention.

FIG. 10 illustrates an alternate embodiment wherein the lock mechanism comprises a ring spring 195. The ring spring 195 in the present embodiment is carried in a circumferentially-extending groove 44G' formed in the exterior surface 46' of the stripper plate guide 44'. As is best appreciated with reference to FIG. 11, the ring spring 195 preferably has at least one spring region 197 with a substantially smaller radius than the rest of the ring spring 195. The ring spring 195 shown in FIG. 11 has two spring regions 197 at diametrically-opposed locations on the circumference of the ring spring 159. However, essentially any number (i.e., one or more) of spring regions can be provided. When the ring spring 195 is mounted in the groove 44G' in the stripper plate guide 44', most of the circumferential extent of the ring spring 195 is carried flush against the exteriorly-facing surface of the groove 44G'. However, the arcuate length of each spring region 197 (when not depressed) extends radially outward beyond the interior surface 26' of the punch guide's leading wall section 11'. Thus, with the stripper plate guide 44' in its locked position, the outwardly-extending spring region 197 of the ring spring 195 extends into an opening 142 formed in the wall of the punch guide 16' and engages the edge 142E of this punch guide wall surrounding and defining the opening 142. This has the effect of restraining axial forward movement of the stripper plate guide 44' relative to the punch guide 16'. When it is desired to remove this restraint, each spring region 197 of the ring spring 195 is depressed. This frees the stripper plate guide 44' to move axially forward relative to the punch guide 16', and each spring 111' then urges the stripper plate guide 44' toward (and moves it into) its unlocked position.

The punch guide assembly preferably includes at least one clip 80 that lockingly engages the stripper plate 22 when the stripper plate guide 44 is in its locked position. This can be understood with reference to FIG. 5A in view of FIG. 1, wherein the illustrated clip is identified by the reference numeral 80. It can be appreciated that the illustrated clip 80 has a head 82 that is held against a peripheral edge of the stripper plate 22 when the stripper plate guide 44 is in its locked position. In particular, the illustrated stripper plate 22 has a peripheral base flange 23 that is trapped between the head 82 of the clip 80 and a front surface 45 of the stripper plate guide 44. Thus, the stripper plate 22 is fixedly secured to the punch guide assembly when the stripper plate guide 44 is in its locked position.

Figure 6A:
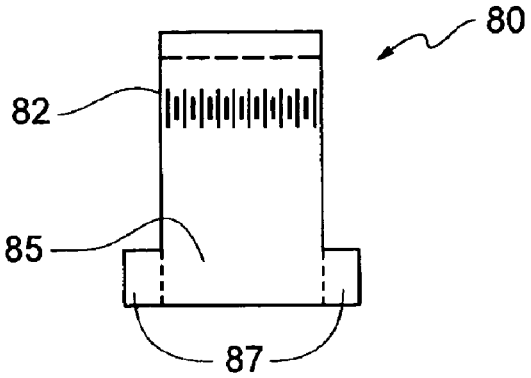
FIG. 6A is a front view of a clip used in certain embodiments of the invention.
Figure 6B:
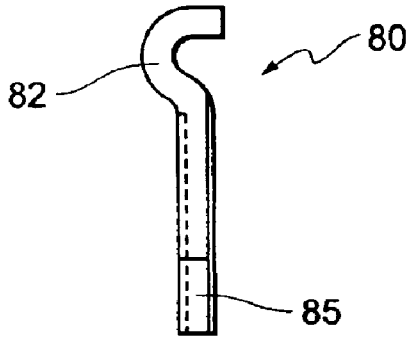
FIG. 6B is a side view of the clip of FIG. 6A.
Figure 6C:
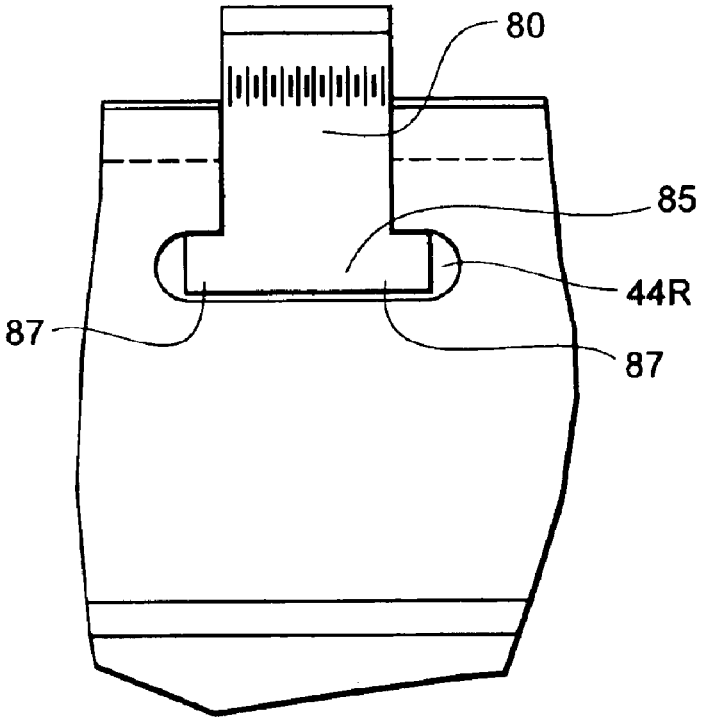
FIG. 6C is a front view of the clip of FIG. 6A depicted as mounted in a recess defined by a stripper plate guide in accordance with certain embodiments of the invention.

In certain preferred embodiments, the base 85 of the clip 80 is mounted between the stripper plate guide 44 and the punch guide 16. This can be accomplished in a variety of ways. For example, the base 85 of the clip 80 can have a particular configuration, and the exteriorly-facing surface 46 of the stripper plate guide 44 can have therein formed a correspondingly-configured recess 44R adapted to receive the clip base 85. This is perhaps best appreciated with reference to FIGS. 6A–6C, wherein one particular embodiment of this nature is illustrated. The illustrated clip 80 comprises a base 85 having two opposed extensions 87, such that the clip 80 has a generally "T"-shaped configuration (i.e., the base 85 of the clip 80 has a greater width W than the rest of the clip 80). Conjointly, the exterior wall of the illustrated stripper plate guide 44 defines a generally "T"-shaped recess 44R. Thus, when the base of the clip 80 is positioned in the recess 44R and the stripper plate guide 44 is nested inside the punch guide 16, the clip 80 is trapped in the recess 44H by the interior wall of the punch guide 16. While the illustrated clip 80 has a T-shaped configuration, the base of the clip 80 can be provided in a variety of different configurations (and the recess 44H in the stripper plate guide 44 can be provided in a variety of corresponding configurations).

Figure 7:
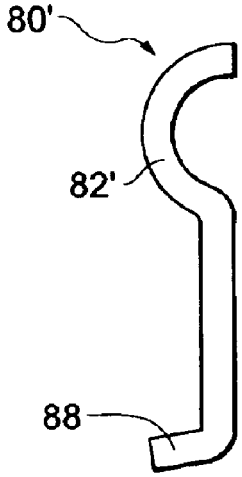
FIG. 7 is a side view of a clip used in certain alternate embodiments of the invention.

FIG. 7 illustrates another clip 80' that can be used with the stripper plate retention system. The illustrated clip 80' is similar to that described above, except that the present clip 80' has a bent bottom length 88. Further, in this embodiment, the clip 80' would commonly not have a T-shaped configuration. Rather, the clip 80' may have a constant width W between its head 82' and its bent bottom length 88. A clip 80' of this nature can be mounted between the stripper plate guide 44 and the punch guide 16 in the manner depicted in FIG. 10. For example, the exterior surface 46' of the stripper plate guide 44' can have therein formed a slot adapted to receive the bent bottom length 88' of the clip 80'. The head 82' of the clip 80' may have the same generally "C"-shaped configuration (e.g., the same arcuate bend) as the clip 80 described above. Of course many other clip configurations can be used. For example, alternate embodiments (not shown) involve a clip having a plurality of pins or the like extending from the interior side 80S' of the clip. Such pins may be received in corresponding openings (not shown) in the exterior wall 46 of the stripper plate guide 44. Many other embodiments of this nature can be provided as well.

Figure 9:
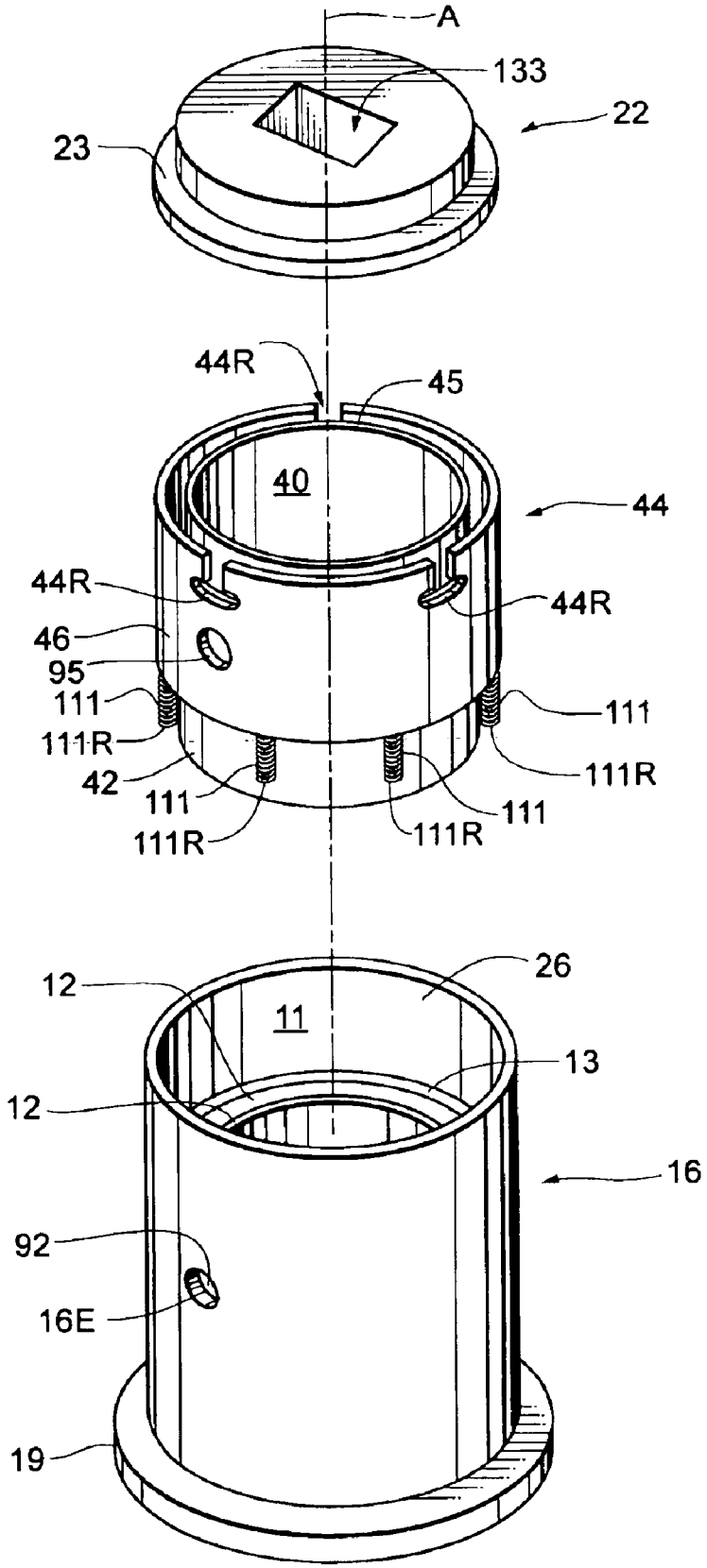
FIG. 9 is an exploded perspective view of a punch guide assembly in accordance with certain embodiments of the invention.

In certain particularly preferred embodiments, the assembly comprises a plurality of clips 80. This can be appreciated with reference to FIG. 9, wherein the illustrated stripper plate guide 44 has therein formed a plurality of circumferentially-spaced recesses 44H each adapted to receive the base of a clip 80 of the described nature. The clips 80 lockingly engage the stripper plate 22 when the stripper plate guide 44 is in its locked position. For example, the clips 80 preferably have heads 82 that are held against a peripheral edge of the stripper plate 22 when the stripper plate guide 44 is in its locked position. In the embodiment of FIG. 9, the stripper plate guide 44 is adapted to carry three clips 80 spaced approximately every 60 degrees about the circumference of the stripper plate guide 44. Essentially any desired number of clips 80 can be used, although it is preferable to provide at least three clips 80 to achieve stable, secure stripper plate retention. It can be appreciated with reference to FIGS. 5A–5B in view of FIGS. 1 and 2 that axial forward movement of the stripper plate guide 44 to its unlocked position moves each clip 80 into a position wherein the head of the clip 80 is free to move somewhat away from (i.e., out of engagement with) the peripheral edge of the stripper plate 22, such that the stripper plate 22 can be readily removed from the punch guide assembly.

Figure 8C:
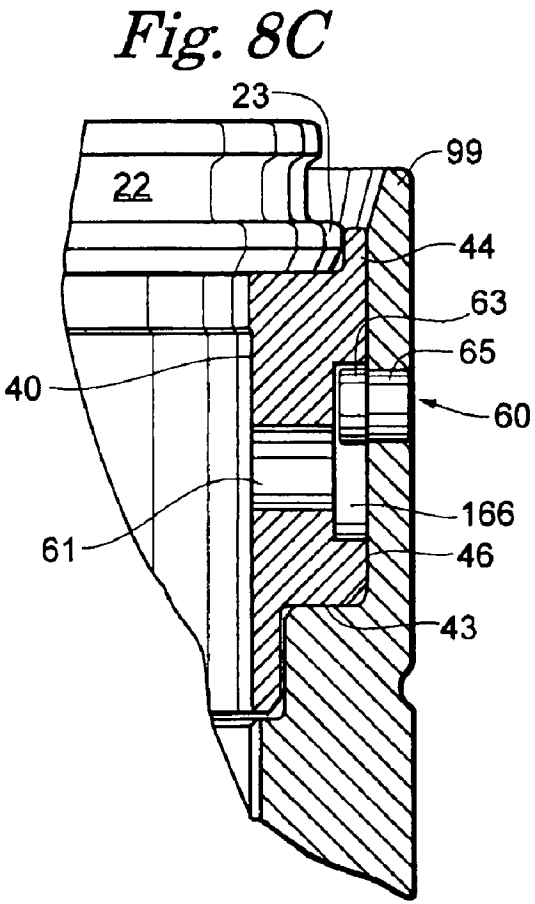
FIG. 8C is a cross-sectional view of the fastener of FIG. 8A depicted connecting the stripper plate guide to the punch guide with the stripper plate guide in a locked position.
Figure 8B:
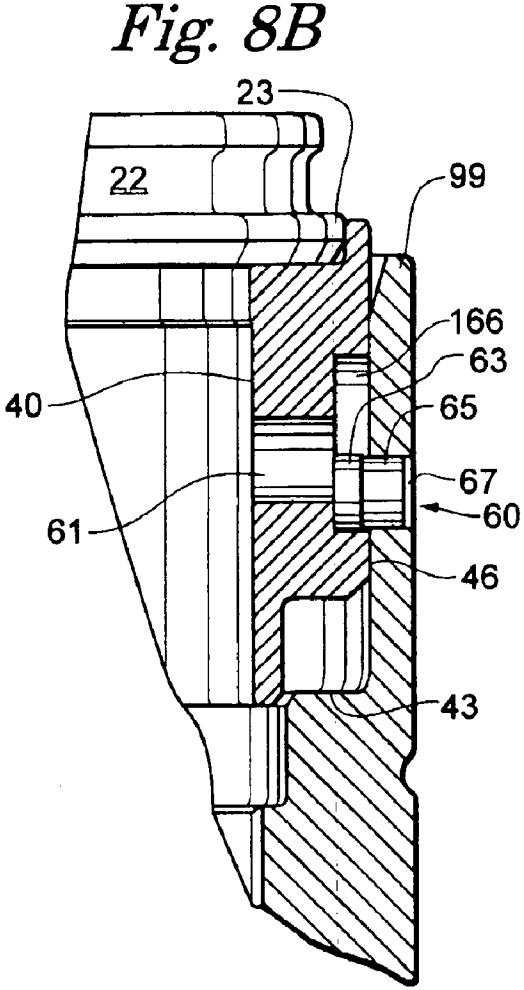
FIG. 8B is a cross-sectional view of the fastener of FIG. 8A depicted connecting the stripper plate guide to the punch guide with the stripper plate guide in an unlocked position.
Figure 8A:
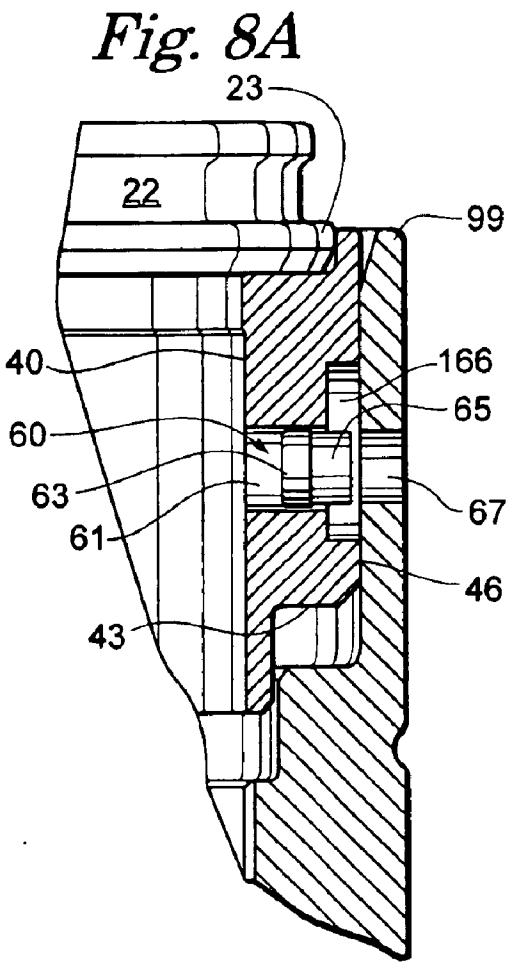
FIG. 8A is a cross-sectional view depicting the mounting of a fastener for connecting a stripper plate guide to a punch guide in accordance with certain embodiments of the invention.

As can be appreciated in FIGS. 8A–8C and 10, the stripper plate guide 44 is preferably mounted to the punch guide 16 by at least one fastener 60, 60'. When mounted in the manner illustrated, the stripper plate guide 44 has a limited range of freedom to move axially relative to the punch guide 16. As illustrated in FIG. 8A, the stripper plate guide 44 is mounted on the punch guide 16 by positioning the stripper plate guide 44 inside the leading wall section 11 of the punch guide 16 and inserting the fastener 60 (which in FIGS. 8A–8C is a ring pin) into an opening 61 in the stripper plate guide 44 (in the manner illustrated). This opening 61 preferably extends entirely through the stripper plate guide 44, opening at one end through the interiorly-facing surface 40 of the stripper plate guide 40, and opening at the other end into an elongated opening 166 (i.e., elongated in the direction of travel of the stripper plate guide 44, that is, elongated in the direction of axis A) that opens through the exteriorly-facing surface 46 of the stripper plate guide 44. The stripper plate guide 44 and the punch guide 44 are brought into a relative position wherein the opening 61 in the stripper plate guide 44 is aligned with an opening 67 in the punch guide 16. The fastener 60 (e.g., a ring pin) is then advanced through the opening 61 in the stripper plate guide 44 until the forward portion 65 (e.g., the reduced diameter portion of a ring pin) of the fastener 60 engages the opening 67 in the punch guide 16. If so desired, the forward portion 65 of the fastener 60 may be threaded, and the edge of the punch guide wall defining the opening 67 may be threaded as well, such that the fastener 60 is engaged threadingly with the wall of the punch guide 16. With the fastener 60 mounted in the manner depicted in FIG. 8C, the stripper plate guide 44 is free to move axially between its locked position (shown in FIG. 8C) and its unlocked position (shown in FIG. 8B). In so moving the stripper plate guide 44, the elongated opening 166 in the stripper plate guide 44 allows the stripper plate guide 44 to pass freely over the head 63 of the fastener 60, which is fixed in a stationary position in the wall of the punch guide 16.

Preferably, the stripper plate guide 44 is mounted to the punch guide 16 with at least two fasteners 60. For example, two fasteners can be located at diametrically-opposed locations on the circumference of the punch guide, with each fastener fixed in a stationary position in the wall of the punch guide. Of course, any number of fasteners can be provided. Skilled artisans will recognize that a variety of other mechanisms can be used to mount the stripper plate guide on the punch guide.

Assembly of the stripper plate guide and the punch guide is perhaps best understood with reference to FIG. 9. As noted above, the stripper plate guide 44 is nested inside the leading wall section 11 of the punch guide 16 during use. Before placing the stripper plate guide 44 inside the punch guide 16, the springs 111 are positioned in the spring bores 111B, preferably after lubricating the springs 111 in a conventional manner. Such lubricant facilitates proper functioning of the springs 111. It also tends to keep the springs 111 in (i.e., it prevents them from falling out of) the spring bores 111B, even when the stripper plate guide 44 is held in the position shown in FIG. 9. The button assembly 95 is positioned in a recess configured (i.e., sized and shaped) to receive the button assembly 95. The clips 80 are positioned in respective recesses 44R in the exterior wall 46 of the stripper plate guide 44. The button 95 is then depressed and aligned with the button hole 92 in the punch guide 16 while the stripper plate guide 44 is advanced to the interior of the punch guide.

Figure 5A:
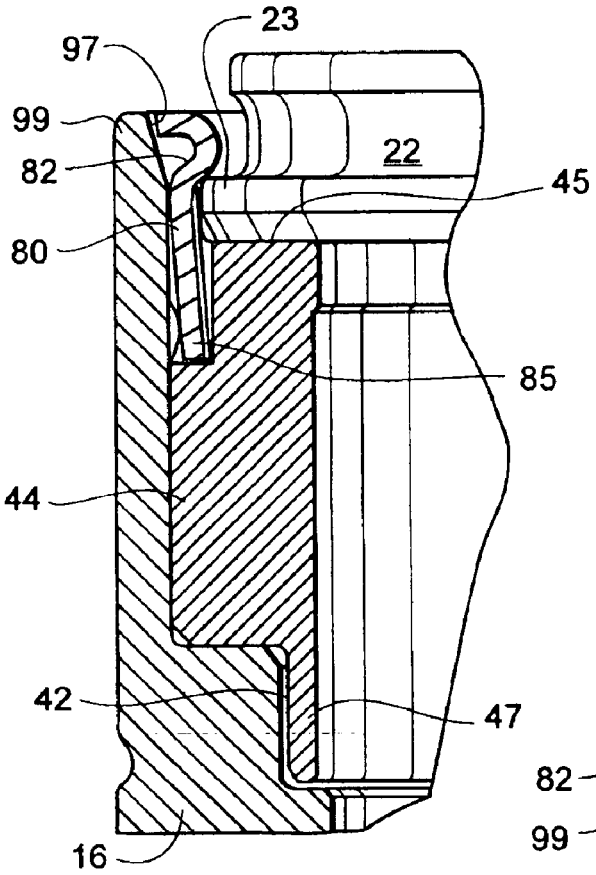
FIG. 5A is a cross-sectional view of a stripper plate guide carrying a clip in a locked position in accordance with certain embodiments of the invention.

As the stripper plate guide 44 is so advanced, the openings 61 in the stripper plate guide 44 are moved into alignment with the corresponding openings 67 in the wall of the punch guide 16. A fastener 60 is then inserted from the interior side of each opening 61 in the stripper plate guide 44 into engagement with the corresponding opening 67 in the wall of the punch guide 16, as described above with reference to FIGS. 8A–8C. If so desired, the stripper plate 22 may at this point be positioned on the forward surface 45 of the stripper plate guide 44. The stripper plate guide 44 is advanced until the spring-loaded button 95 reaches the button hole 92 in the wall of the punch guide 16, at which point the spring 95S behind the button 95 urges the button 95 radially outward into the button hole 92. At this stage, the stripper plate guide 44 is in its locked position, wherein the stripper plate 22 is secured to the punch guide assembly. In this position, the heads 82 of the clips 80 hold the stripper plate 22 against the front surface 45 of the stripper plate guide 44 (as seen in FIG. 5A) and the springs 111 are compressed in the spring bores 111B (as seen in FIG. 4A).

Figure 5B:
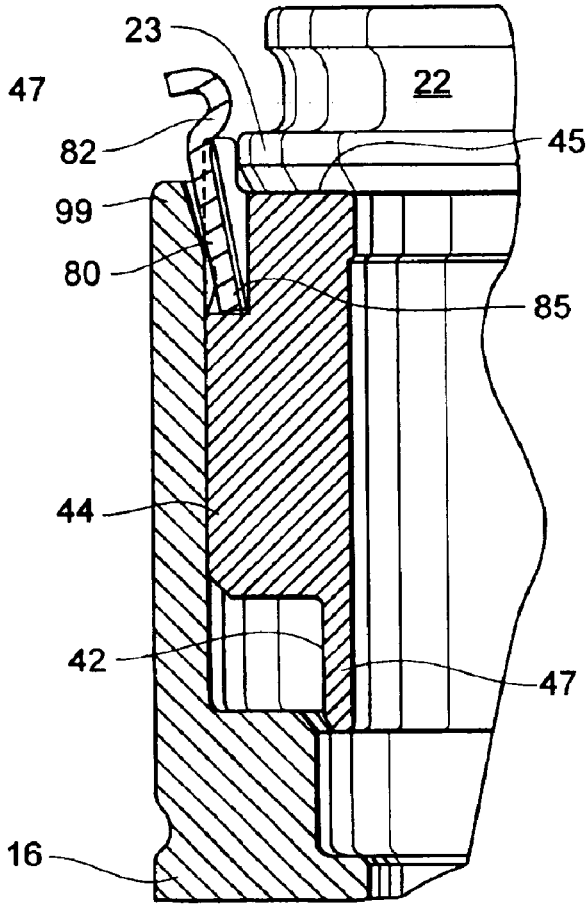
FIG. 5B is a cross-sectional view of the stripper plate guide of FIG. 5A depicted in an unlocked position.

To release the stripper plate 22 from the punch guide assembly, the operator has only to press the spring-loaded button 95. This moves the button 95 radially inward and out of engagement with the button hole 92 in the wall of the punch guide 44 (hence freeing the stripper plate guide to move axially forward relative to the punch guide ). This in turn causes the force of the springs 111 on the stripper plate guide 44 to move the stripper plate guide 44 toward its unlocked position (i.e., the springs 111 push the stripper plate guide 44 axially forward). As the stripper plate guide 44 reaches its unlocked position, the optional tapered lip 99 of the punch guide 16 allows the heads 82 of the clips 80 to fall away from the stripper plate 22, as depicted in FIG. 5B. At this point, the stripper plate guide 44 is in its unlocked position, and the stripper plate 22 can be freely removed from the punch guide assembly.

While preferred embodiments of the present invention have been described, it should be understood that a variety of changes, adaptations, and modifications can be made therein without departing from the spirit of the invention and the scope of the appended claims.

What is claimed is:

1. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide is resiliently biased axially toward its unlocked position yet is restrained against axial movement relative to the punch guide when in its locked position, the stripper plate guide being resiliently biased axially toward its unlocked position by at least one spring bearing against the stripper plate guide, wherein the assembly includes a lock mechanism that restrains the stripper plate guide when in the locked position, the lock mechanism comprising a catch extending between the stripper plate guide and the punch guide, wherein the catch either extends from the stripper plate guide and can be selectively engaged with the punch guide or extends from the punch guide and can be selectively engaged with the stripper plate guide.

2. The assembly of claim 1 wherein the stripper plate guide is resiliently biased axially toward its unlocked position by said at least one spring bearing against the stripper plate guide, and wherein the assembly further includes a punch spring surrounding a punch driver, the punch spring being held in position between a collar secured to the punch guide and a block secured to the punch driver.

3. The assembly of claim 1 wherein the stripper plate guide is carried against an interior wall of the punch guide.

4. The assembly of claim 1 wherein the stripper plate guide comprises a generally ring-shaped wall.

5. The assembly of claim 4 wherein the stripper plate guide is mounted within a generally-cylindrical wall of the punch guide.

6. The assembly of claim 5 wherein the stripper plate guide has an exterior diameter that is slightly less than an interior diameter of said generally-cylindrical wall of the punch guide.

7. The assembly of claim 1 wherein the stripper plate guide is resiliently biased by a plurality of springs extending between the stripper plate guide and the punch guide.

8. The assembly of claim 7 wherein the springs are disposed within a substantially-concealed enclosure whether the stripper plate guide is in its locked position or its unlocked position.

9. The assembly of claim 8 wherein said enclosure is defined by the punch guide in cooperation with the stripper plate guide.

10. The assembly of claim 9 wherein the stripper plate guide has a flange that overlaps a confronting interior surface of the punch guide by an extent that varies as the stripper plate guide is moved between its locked position and its unlocked position, said enclosure being bounded by said flange.

11. The assembly of claim 10 wherein the extent of said overlap is greatest when the stripper plate guide is in its locked position and least when the stripper plate guide is in its unlocked position.

12. The assembly of claim 1 wherein the lock mechanism comprises a button assembly or a ring spring.

13. The assembly of claim 12 wherein the lock mechanism is a spring-loaded button that is extendable from the stripper plate guide into, and hence engageable with, an opening in the punch guide.

14. The assembly of claim 13 wherein the spring-loaded button, when engaged with said opening in the punch guide, can be depressed to move the button out of engagement with said opening in the punch guide such that the stripper plate guide is free to move axially forward relative to the punch guide.

15. The assembly of claim 1 wherein at least one clip lockingly engages the stripper plate when the stripper plate guide is in its locked position.

16. The assembly of claim 15 wherein a plurality of circumferentially-spaced clips lockingly engage the stripper plate when the stripper plate guide is in its locked position.

17. The assembly of claim 16 wherein the clips have heads that are held against a peripheral edge of the stripper plate when the stripper plate guide is in its locked position.

18. The assembly of claim 17 wherein axial forward movement of the stripper plate guide to its unlocked position moves the clips into a position wherein the heads of the clips are free to move apart from the peripheral edge of the stripper plate, such that the stripper plate can be readily removed from the punch guide assembly.

19. The assembly of claim 16 wherein each clip has a base that is mounted between the stripper plate guide and the punch guide.

20. The assembly of claim 19 wherein the base of each clip has a particular configuration and is received in a correspondingly-configured recess formed in the stripper plate guide.

21. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide when in its locked position is restrained against axial movement relative to the punch guide by a lock mechanism comprising a catch extending between the punch guide and the stripper plate guide, wherein the catch either extends from the stripper plate guide and can be selectively engaged with the punch guide or extends from the punch guide and can be selectively engaged with the stripper plate guide, and wherein the stripper plate guide is resiliently biased axially toward its unlocked position by at least one spring bearing against the stripper plate guide, the assembly further including a punch spring surrounding a punch driver, the punch spring being held in position between a collar secured to the punch guide and a block secured to the punch driver.

22. The assembly of claim 21 wherein the lock mechanism is a spring-loaded button that is extendable from the stripper plate guide into, and hence engageable with, an opening in the punch guide.

23. The assembly of claim 22 wherein the spring-loaded button, when engaged with said opening in the punch guide, can be depressed to move the button out of engagement with said opening in the punch guide such that the stripper plate guide is free to move axially forward relative to the punch guide.

24. The assembly of claim 21 wherein the stripper plate guide is resiliently biased by a plurality of springs extending between the stripper plate guide and the punch guide.

25. The assembly of claim 24 wherein the springs are disposed within a substantially-concealed enclosure whether the stripper plate guide is in its locked position or its unlocked position.

26. The assembly of claim 25 wherein said enclosure is defined by the punch guide in cooperation with the stripper plate guide.

27. The assembly of claim 26 wherein the stripper plate guide has a flange that overlaps a confronting interior surface of the punch guide by an extent that varies as the stripper plate guide is moved between its locked position and its unlocked position, said enclosure being bounded by said flange.

28. The assembly of claim 27 wherein the extent of said overlap is greatest when the stripper plate guide is in its locked position and least when the stripper plate guide is in its unlocked position.

29. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide when in its locked position is restrained against axial movement relative to the punch guide by a lock mechanism comprising a spring-loaded button that is extendable from the stripper plate guide into, and hence engageable with, an opening in a wall of the punch guide, and wherein the stripper plate guide is resiliently biased axially toward its unlocked position by at least one spring bearing against the stripper plate guide, wherein to release the stripper plate from the assembly an operator has only to press the spring-loaded button so as to move the button radially inward and out of engagement with the opening in the wall of the punch guide.

30. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and is restrained against axial movement relative to the punch guide, the stripper plate guide having an unlocked position wherein the stripper plate can be readily removed from the punch guide assembly, the stripper plate guide being resiliently biased axially toward its unlocked position by a plurality of springs extending between the stripper plate guide and the punch guide, wherein the springs are disposed within a substantially-concealed enclosure whether the stripper plate guide is in its locked position or its unlocked position, the enclosure being defined collectively by an exteriorly-facing surface of a flange of the stripper plate guide, a forward-facing surface of a first shoulder of the punch guide, a rear extent of an interior surface of a leading wall section of the punch guide, and a rear surface of the stripper plate guide.

31. The assembly of claim 30 wherein the springs are disposed within said enclosure at all positions of the stripper plate guide between its locked position and its unlocked position.

32. The assembly of claim 30 wherein said enclosure is defined by the punch guide in cooperation with the stripper plate guide.

33. The assembly of claim 31 wherein the stripper plate guide has a flange that overlaps a confronting interior surface of the punch guide by an extent that varies as the stripper plate guide is moved between its locked position and its unlocked position, said enclosure being bounded by said flange.

34. The assembly of claim 33, wherein the extent of said overlap is greatest when the stripper plate guide is in its locked position and least when the stripper plate guide is in its unlocked position.

35. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide is resiliently biased axially toward its unlocked position yet is restrained against axial movement relative to the punch guide when in its locked position, wherein a plurality of circumferentially-spaced clips lockingly engage the stripper plate when the stripper plate guide is in its locked position, and wherein each clip has a base that is mounted between the stripper plate guide and the punch guide.

36. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide is resiliently biased axially toward its unlocked position yet is restrained against axial movement relative to the punch guide when in its locked position, wherein the stripper plate guide comprises a generally ring-shaped wall and is resiliently biased axially toward the unlocked position by at least one spring mounted in a bore formed in the stripper plate guide.

37. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide when in its locked position is restrained against axial movement relative to the punch guide by a lock mechanism comprising a spring-loaded button that is extendable from the stripper plate guide into, and hence engageable with, an opening in the punch guide, and wherein the stripper plate guide is resiliently biased axially toward its unlocked position by springs bearing against the stripper plate guide such that when the button is depressed the springs move the stripper plate guide axially into the unlocked position.

38. A punch guide assembly for removably carrying a stripper plate, the assembly comprising a punch guide and a stripper plate guide movable axially with respect to the punch guide, the stripper plate guide having a locked position wherein the stripper plate is secured to the punch guide assembly and an unlocked position wherein the stripper plate can be readily removed from the punch guide assembly, wherein the stripper plate guide is resiliently biased axially toward its unlocked position yet is restrained against axial movement relative to the punch guide when in its locked position, the punch guide having a base wall section and a leading wall section, the stripper plate guide being mounted against an interior of the punch guide's leading wall section such that an exteriorly-facing surface of the stripper plate guide slides against an interiorly-facing surface of the punch guide's leading wall section when the stripper plate guide is moved axially with respect to the punch guide, the leading wall section of the punch guide having a greater interior dimension than the base wall section, the leading wall section having the same exterior dimension as the base wall section such that the base wall section has a first shoulder defined by a first forward-facing surface and a first interiorly-facing surface, wherein the stripper plate guide is resiliently biased axially toward its unlocked position by a plurality of springs extending between the punch guide and the stripper plate guide, and wherein each spring has a leading end that applies forward force to the stripper plate guide and a rear end that applies rearward force to the punch guide.

39. The punch guide assembly of claim 38 wherein the base wall section of the punch guide further includes a second shoulder defined by a second forward-facing surface and a second interiorly-facing surface, the second shoulder cooperating with a flange on the stripper plate guide to substantially conceal the springs against exposure to dirt and other particles that can be detrimental to proper functioning of the springs.

40. The punch guide assembly of claim 29 wherein pressing the spring-loaded button so as to move the button radially inward and out of engagement with the opening in the wall of the punch guide frees the stripper plate guide to move axially forward relative to the punch guide, this in turn causing said at least one spring to push the stripper plate guide axially forward toward the unlocked position, wherein the assembly includes a plurality of circumferentially-spaced clips that lockingly engage the stripper plate when the stripper plate guide is in the locked position, the clips having heads that are held against a peripheral edge of the stripper plate when the stripper plate guide is in the locked position, wherein axial forward movement of the stripper plate guide to the unlocked position moves the clips into a position wherein the heads of the clips are free to move apart from the peripheral edge of the stripper plate such that the stripper plate can be readily removed from the punch guide assembly, the punch guide having a tapered lip that allows said movement apart to occur by the heads of the clips falling away from the stripper plate.

* * * * *